US007017586B2

(12) United States Patent
Tsutsumi et al.

(10) Patent No.: US 7,017,586 B2
(45) Date of Patent: Mar. 28, 2006

(54) CIGARETTE

(75) Inventors: Takeo Tsutsumi, Yokohama (JP); Keigo Miura, Yokohama (JP)

(73) Assignee: Japan Tobacco, Inc., Tokyo (JP)

( * ) Notice: Subject to any disclaimer, the term of this patent is extended or adjusted under 35 U.S.C. 154(b) by 0 days.

(21) Appl. No.: 10/618,686

(22) Filed: Jul. 15, 2003

(65) Prior Publication Data

US 2004/0011368 A1 Jan. 22, 2004

Related U.S. Application Data

(63) Continuation of application No. PCT/JP02/00047, filed on Jan. 9, 2002.

(30) Foreign Application Priority Data

Jan. 15, 2001 (JP) ..... 2001-006763

(51) Int. Cl.
*A24D 1/02* (2006.01)

(52) U.S. Cl. ..... 131/365; 131/349

(58) Field of Classification Search ..... 131/365, 131/349; 162/139

See application file for complete search history.

(56) References Cited

U.S. PATENT DOCUMENTS

| | | | | |
|---|---|---|---|---|
| 5,105,835 | A * | 4/1992 | Drewett et al. | 131/349 |
| 5,203,355 | A | 4/1993 | Clearman et al. | |
| 5,327,915 | A | 7/1994 | Porenski et al. | |
| 5,921,249 | A | 7/1999 | Hampl, Jr. | |
| 6,000,404 | A * | 12/1999 | Case et al. | 131/331 |

FOREIGN PATENT DOCUMENTS

| | | | |
|---|---|---|---|
| DE | 4202750 | * | 8/1993 |
| JP | 54-151198 | A | 11/1979 |
| JP | 55-29955 | A | 3/1980 |
| JP | 56-144081 | A | 11/1981 |
| JP | 59-21800 | A | 2/1984 |
| JP | 60-164472 | A | 8/1985 |
| JP | 63-84474 | A | 4/1988 |
| JP | 3023127 | B1 | 1/2000 |

* cited by examiner

*Primary Examiner*—Dionne A. Walls
(74) *Attorney, Agent, or Firm*—Birch, Stewart, Kolasch & Birch, LLP

(57) ABSTRACT

A cigarette comprises a tobacco section including a columnar tobacco filler material and at least one cellulose-based wrapping paper sheet for wrapping the outer circumferential surface of the columnar tobacco filler material. The outermost wrapping paper sheet among the wrapping paper sheets has a thermal conductivity not lower than 0.5 $W \cdot K^{-1} \cdot m^{-1}$.

4 Claims, No Drawings

CIGARETTE

CROSS-REFERENCE TO RELATED APPLICATIONS

This is a Continuation Application of PCT Application No. PCT/JP02/00047, filed Jan. 9, 2002, which was not published under PCT Article 21(2) in English.

This application is based upon and claims the benefit of priority from the prior Japanese Patent Application No. 2001-006763, filed Jan. 15, 2001, the entire contents of which are incorporated herein by reference.

BACKGROUND OF THE INVENTION

1. Field of the Invention

The present invention relates to a cigarette, and more particularly, to a cigarette extinguishable unless smoked for a certain period of time after ignition.

2. Description of the Related Art

It is widely known that a cigar exhibits a so-called self-extinguishing phenomenon that the burning portion is extinguished, unless the cigar is smoked for a certain period of time. Although there are various opinions concerning the causes of the self-extinguishing phenomenon, it is clearly one of the causes of the self-extinguishing phenomenon that the wrapper (tobacco leaves or a sheet prepared by processing tobacco leaves) of the cigar covering the shredded tobacco is unlikely to be burned. On the other hand, it has also been attempted to manufacture a self-extinguishing cigarette by using a wrapping paper sheet that is unlikely to be burned. Concerning the particular wrapping paper sheet, a wrapping paper sheet mixed with a metal is proposed in, for example, Japanese Patent Disclosure (Kokai) No. 55-29955, and a wrapping paper sheet mixed with sepiolite is proposed in Japanese Patent Disclosure No. 59-21800. Also, disclosed in Japanese Patent Disclosure No. 60-164472 is a self-extinguishing cigarette, in which an inflammable material such as an aluminum foil is formed annular around a wrapping paper sheet such that the burning of the cigarette is stopped at the annular inflammable material if the cigarette is not smoked for a certain period of time.

The conventional design technology of the self-extinguishing smoking article can be said to be satisfactory when it comes to only the aspect of providing merely a self-extinguishing cigarette. However, the smoker feels very inconvenience, if the ignition is poor in smoking, for example, a cigar. Also, the pleasant smoking time is spoiled if the cigar is extinguished during the smoking. Such a problem also takes place in the conventional self-extinguishing cigarette. The cause of the problem is that, in the conventional cigarette design technology, attention is paid to the self-extinguishing properties alone, and the general smoking behavior of the smoker is neglected. In the standard smoking state (ISO), the time between the adjacent puffs (static burn time) is defined to be 58 seconds. However, it is not reasonable to define uniformly the static burn time because smoking is a pleasure enjoyed by the individual smoker, though a cigarette that continues the static burn for a long time is not desirable in view of fire prevention.

Accordingly, an object of the present invention is to provide a self-extinguishing cigarette, in which the static burn time is assumed to be about 2 to 4 minutes, which is far beyond the static burn time in the ordinary smoking behavior, so as to permit the cigarette to be self-extinguished if the static burn of the cigarette is continued for at least 2 minutes.

BRIEF SUMMARY OF THE INVENTION

As a result of an extensive research on a cigarette that is self-extinguished a certain period of time after the ignition of the cigarette under the natural smoking environment, the present inventors have found that the ignited cigarette is self-extinguished a certain period of time later if the outermost wrapping paper sheet among the wrapping paper sheets constituting the wrapping material of the tobacco filler material has a thermal conductivity of at least 0.5 $W \cdot K^{-1} \cdot m^{-1}$. The present invention is based on this finding.

Thus, the present invention provides a cigarette comprising a tobacco section including a columnar tobacco filler material and a wrapping material including at least one cellulose-based wrapping paper sheet, wrapping the outer circumferential surface of the columnar tobacco filler material, wherein the outermost wrapping paper sheet of the wrapping material has a thermal conductivity of 0.5 $W \cdot K^{-1} \cdot m^{-1}$ or more.

In the present invention, it is preferable that the outermost wrapping paper sheet contain 0 to 6% by weight of a loading or filler material.

DETAILED DESCRIPTION OF THE INVENTION

A cigarette according to the present invention comprises a tobacco section including a columnar tobacco filler material and a wrapping material including at least one cellulose-based wrapping paper sheet, wrapping the outer circumferential surface of the columnar tobacco filler material.

In the cigarette of the present invention, the wrapping material wrapping the tobacco section includes at least one wrapping paper sheet. The at least one wrapping paper sheet constituting the wrapping material is based on cellulose, and pulp used for manufacturing an ordinary wrapping paper sheet such as hemp pulp or wood pulp can be used as a base material of the wrapping paper sheet. The wrapping sheet on the outermost side among the wrapping paper sheets constituting the wrapping material has a thermal conductivity of at least 0.5 $W \cdot K^{-1} \cdot m^{-1}$. The thermal conductivity of the wrapping paper sheet can be controlled by controlling the amounts of a loading or filler material (generally, calcium carbonate, magnesium hydroxide, etc.) added to the pulp base material and the amount of pulp, as well as the paper layer structure. It is desirable for the outermost wrapping paper sheet to contain 0 to 6% of the loading material. It is possible to add a burn control agent such as sodium citrate or potassium citrate to the outermost wrapping paper sheet in an amount of, for example, 0 to 1.0% by weight. In the present invention, it is possible for the outermost wrapping paper sheet to have in general a thermal conductivity up to 0.6 $W \cdot K^{-1} \cdot m^{-1}$. It is desirable for the outermost wrapping paper sheet to have a thermal conductivity falling within a range of 0.52 to 0.56 $W \cdot K^{-1} \cdot m^{-1}$. Also, it is desirable for the outermost wrapping paper sheet to have a basis weight of about 15 to 35 $g/m^2$, though the basis weight is not particularly limited in the present invention.

In the present invention, the wrapping material wrapping the tobacco filler material may be formed solely of a wrapping paper sheet having a thermal conductivity of 0.5 $W \cdot K^{-1} \cdot m^{-1}$ or more. However, the current wrapping paper sheet having a thermal conductivity of 0.5 $W \cdot K^{-1} \cdot m^{-1}$ or more has a high transparency. As a result, if the tobacco filler material is wrapped with the particular wrapping paper sheet alone, the tobacco filler material can be seen through the wrapping paper sheet, with the result that it is possible to impart a sense of incompatibility to the ordinary cigarette smoker. Such being the situation, it is desirable to wrap the tobacco filler material with the ordinary cigarette wrapping paper sheet (inside wrapping paper sheet) and, then, with a wrapping paper sheet having a thermal conductivity of 0.5 $W \cdot K^{-1} \cdot m^{-1}$. The inside wrapping paper sheet may have a basis weight of 10 to 30 $g/m^2$, and may contain 20 to 35% by weight of the loading material and 0 to 1.0 mass % of the burn control agent.

The tobacco filler material is not particularly different from that conventionally used in cigarettes. The ordinary threaded tobacco and other substitute smoking materials can be used as the tobacco filler material. The loading density of the tobacco filler material is not different from that used in the conventional cigarette.

Also, the cigarette of the present invention may have an ordinary filter mounted to one end of the tobacco section.

Examples of the present invention will be described below.

Cigarettes were manufactured by the ordinary method by each using one wrapping paper sheet having the specification as shown in Table 1. Table 1 shows the thermal conductivity, the basis weight, the loading material (% by weight of calcium carbonate), and the burn control agent (% by weight of potassium citrate). In each cigarette, the threaded tobacco was an ordinary commercial American blend and was loaded in a loading density of 237 $mg/cm^3$. Also, each cigarette had a circumferential length of 24.8 mm. The static burn rate of each cigarette was measured under a flat calm, with the cigarette disposed laterally. The thermal conductivity of the cigarette was measured by the non-steady planar heat source method. Also measured was the time until the cigarette subjected to static burn to stop burning. The results are also shown in Table 1.

TABLE 1

| | | Specification of Wrapping Paper Sheet | | | | | Cigarette | |
|---|---|---|---|---|---|---|---|---|
| Kind | | Basis Weight ($g/m^2$) | Loading Material (%) | Burn Control Agent (%) | Thermal Conductivity (W/Km) | Air Permeability (CORESTA unit) | Static Burn Rate (mm/min) | Time until Burn Stops (min) |
| Comp. Ex. | A | 30 | 32 | 5.0 | 0.39 | 29 | 6.89 | — |
| | B | 31 | 40 | 1.0 | 0.38 | 25 | 5.52 | |
| | C | 32 | 14 | 0 | 0.43 | 26 | 4.15 | |
| Present Invention | D | 30 | 6 | 0 | 0.52 | 12 | — (Natural extinction) | 3.5 |
| | E | 30 | 0 | 0 | 0.56 | 8 | — (Natural extinction) | 2.5 |
| | F | 30 | 0 | 1 | 0.56 | 8 | — (Natural extinction) | 2.5 |

As apparent from Table 1, the cigarette of the present invention performs the function of self-extinction after static burn for about 2 to 4 minutes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cigarette comprising:

a tobacco section including a columnar tobacco filler material, a wrapping material including at least one cellulose-based wrapping paper sheet, said wrapping material wrapping an outer circumferential surface of the columnar tobacco filler material, wherein said wrapping paper sheet includes an outermost wrapping paper sheet having a thermal conductivity of 0.5 $W \cdot K^{-1} \cdot m^{-1}$ or more; and an inside wrapping paper sheet between said outermost wrapping paper sheet and said filler material, wherein the outermost wrapping paper sheet has a thermal conductivity of 0.5 $W \cdot K^{-1} \cdot m^{-1}$ to 0.6 $W \cdot K^{-1} \cdot m^{-1}$.

2. The cigarette according to claim 1, wherein the outermost wrapping paper sheet contains 0 to 6% by weight of a loading material.

3. The cigarette according to claim 1, wherein the outermost wrapping paper sheet has a thermal conductivity of 0.52 $W \cdot K^{-1} \cdot m^{-1}$ to 0.56 $W \cdot K^{-1} \cdot m^{1}$.

4. The cigarette according to claim 1, wherein the inside wrapping paper sheet has a basis weight of 10 to 30 g/m2, contains 20 to 35% by weight of a loading material and contains 0.0 to 1.0 mass % of a burn control agent.

* * * * *